US007547126B2

(12) United States Patent
Hiratsuka

(10) Patent No.: US 7,547,126 B2
(45) **Date of Patent: *Jun. 16, 2009**

(54) ILLUMINATING DEVICE

(75) Inventor: Toshio Hiratsuka, Tokyo (JP)

(73) Assignee: Kabushikikaisha Mirai, Tokyo (JP)

( * ) Notice: Subject to any disclaimer, the term of this patent is extended or adjusted under 35 U.S.C. 154(b) by 257 days.

This patent is subject to a terminal disclaimer.

(21) Appl. No.: 11/596,664

(22) PCT Filed: Aug. 29, 2006

(86) PCT No.: PCT/JP2006/016972

§ 371 (c)(1),
(2), (4) Date: Nov. 16, 2006

(87) PCT Pub. No.: WO2007/026695

PCT Pub. Date: Mar. 8, 2007

(65) Prior Publication Data

US 2008/0192476 A1 Aug. 14, 2008

(30) Foreign Application Priority Data

Aug. 30, 2005 (JP) ..... 2005-249985

(51) Int. Cl.
*F21S 8/08* (2006.01)

(52) U.S. Cl. ..... 362/413; 362/241; 362/247; 362/250; 362/346; 362/427; 362/800

(58) Field of Classification Search ..... 362/241, 362/247, 250, 346, 413, 427, 518, 545, 612, 362/800

See application file for complete search history.

(56) References Cited

U.S. PATENT DOCUMENTS 7,407,307 B2 * 8/2008 Hiratsuka ..... 362/304

(Continued)

FOREIGN PATENT DOCUMENTS

CN 2604617 Y 2/2004

(Continued)

OTHER PUBLICATIONS

International Search Report dated Dec. 5, 2006.

(Continued)

*Primary Examiner*—Stephen F Husar
(74) *Attorney, Agent, or Firm*—McGinn IP Law Group, PLLC

(57) ABSTRACT

An illuminating device of the invention is an illuminating device which can eliminate an illumination in an unnecessary direction, and selectively illuminate a necessary desired area.

An illuminating device 100 in which an illumination direction is freely changeable, includes: a light source portion 15 including: a light emitter having a plurality of light emitting diodes installed on a base; a first reflector formed of parabolic surfaces which are provided on a light emergence side of the light emitter in such a way as to correspond to the plurality of light emitting diodes, and light emitting faces of which fall in focal positions; and a second reflector having a pair of flat plate-like reflecting surfaces which, being arranged with the light emitting diodes sandwiched therebetween, farther to the light emergence side than the first reflector and parallel to an array direction of the light emitting diodes, reflect light from the light emitting diodes toward the light emergence side; an arm 17 which supports the light source portion on one end thereof; and a light source support 13 which rotatably supports the other end of the arm 17.

6 Claims, 17 Drawing Sheets

U.S. PATENT DOCUMENTS

| | | | | |
|---|---|---|---|---|
| 2003/0165061 | A1 | 9/2003 | Martineau | |
| 2004/0201999 | A1 | 10/2004 | Yueh | |
| 2005/0168999 | A1 * | 8/2005 | Sommers et al. | 362/427 |

FOREIGN PATENT DOCUMENTS

| | | |
|---|---|---|
| JP | 63-33878 | 2/1988 |
| JP | 4-123841 | 11/1992 |
| JP | 2000-216437 | 8/2000 |
| JP | 2003-100111 | 4/2003 |
| JP | 2004-128434 | 4/2004 |
| WO | WO 2007/026695 A1 | 3/2007 |

OTHER PUBLICATIONS

Chinese Office Action dated Aug. 1, 2008 with English-Language Translation.

* cited by examiner

ILLUMINATING DEVICE

TECHNICAL FIELD

The present invention relates to an illuminating device equipped with an LED as a light source.

BACKGROUND ART

As a hitherto known illuminating device, particularly, an outdoor illuminating device used for a street light or the like, a high-luminance light source is used, such as a mercury vapor lamp, a high-pressure sodium vapor lamp or a metal halide lamp, which is a high-luminance discharge lamp, and is widely installed around facilities such as a road, a parking lot or the like. Also, as an indoor illuminating device, a fluorescent lamp, an incandescent lamp or the like is widely used for an interior lamp.

Patent Document 1: JP-A-2003-100111

DISCLOSURE OF THE INVENTION

Problems that the Invention is to Solve

However, the illumination aspect does not necessarily fulfill the purpose, and the present situation is that there are many wasteful aspects. For example, unlike a street light which the invention needs, there exist many street lights whose illuminating light does not reach a ground originally required to be illuminated, but wastefully illuminate a night sky. For this reason, a greater part of light from a light source of the street light is not effectively used, leaking and illuminating a neighboring building in some cases. In a case in which a window of a residence is illuminated, as the illuminating light enters a bedroom or a living room from the window, it is necessary to go to the bother of drawing down a lighttight curtain or a blind. Also, there is a street light structured in such a way that a light source emitting light itself is directly visible. Under such an illumination, a person or a driver passing by suffers from a glare, significantly impeding visibility.

In contrast, in recent years, a street lighting device, which can cause a wide surface to emit light using a small number of light emitting diodes, has been developed. For example, a street lighting device disclosed in Patent Document 1 is configured in such a way that light emitting diodes are used as a light source, a cylindrical casing made of a transmissive material such as an acrylic resin is maintained by a support post at a prescribed height from the ground, a plurality of recesses is formed on an inner peripheral surface of the casing which acts as an incidence surface, the light emitting diodes are inserted in the recesses, and light is diffused and reflected from the inner peripheral surface, thereby causing a surface light emission. However, it is not possible to, by causing the light to converge with high efficiency, obtain a high illuminance, and it is not possible to provide an illumination while selectively excluding an area not desired to be illuminated.

Meanwhile, the inventors of this application have developed an illuminating device equipped with a novel reflecting plate which can obtain a high illuminance by converging light from LED's with high efficiency without increasing an output of the LED's (Japanese Patent Application No. 2004-346543). According to the reflecting plate of the illuminating device, it is possible to project the light from the LED's intensively onto a specified range, and illuminate an area within the irradiated range with a high illuminance. Also, as the illuminating device has a characteristic of separating an irradiated area from a non-irradiated area with a clear boundary between them, it is possible to cause an illumination by selectively excluding an area not desired to be illuminated.

The invention has an object of providing an illuminating device which, by applying the novel illuminating device to an illuminating device such as a street light, can eliminate an illumination in an unnecessary direction and selectively illuminate a necessary desired area.

Means for Solving the Problems

The object according to the invention is achieved by the following configuration.

(1) An illuminating device in which an illumination direction is freely changeable, including: a light source portion including: a light emitter having a plurality of light emitting diodes installed on a base; a first reflector formed of parabolic surfaces which are provided on a light emergence side of the light emitter in such a way as to correspond to the plurality of light emitting diodes, and light emitting faces of which fall in focal positions; and a second reflector having a pair of flat plate-like reflecting surfaces which, being arranged with the light emitting diodes sandwiched therebetween, farther to the light emergence side than the first reflector and parallel to an array direction of the light emitting diodes, reflect light from the light emitting diodes toward the light emergence side; an arm which supports the light source portion on one end thereof; and a light source support which rotatably supports the other end of the arm.

In this illuminating device, light from the LED's is converged with high efficiency without increasing an output of the LED's, enabling a high-illuminance illumination within an irradiated range. Also, by pivoting the arm, it becomes possible to separate an irradiated area from a non-irradiated area with a clear boundary between them, making it possible to selectively illuminate a desired area by excluding an area not desired to be illuminated.

(2) An illuminating device according to (1), wherein a plurality of lamp units each including the light source portion and the arm supporting the light source portion is supported on the light source support.

In this illuminating device, as well as the plurality of lamp units enabling an illuminated area to increase, by rotating the arms and causing the irradiated areas to overlap, it becomes possible to form an optional illumination pattern in which a high-illuminance illuminated range is disposed in a desired position.

(3) An illuminating device according to (1) or (2), wherein the light source portion is supported in such a way as to be pivotable with respect to an axis of the arm, and a light irradiation direction is made variable by a pivoting of the light source portion.

In this illuminating device, by the light source portion being pivoted with respect to the axis of the arm, directional illuminating light emerging from the light source portion becomes oriented in an optional direction.

(4) An illuminating device according to any one of (1) to (3), including: a casing which, being formed surrounding a periphery of the light source portion, includes a transparent window on the light emergence side.

In this illuminating device, as the light source portion is surrounded with the casing, it becomes possible to cause illuminating light to emerge from the transparent window while blocking an effect of wind and rain. By this means, while an emergence of high-illuminance illuminating light is being secured, a weatherability is increased, and a durability is improved.

(5) An illuminating device according to any one of (1) to (4), including: a joint which brings the light source portion and the arm into a removable connection.

In this illuminating device, when replacing a light emitting diode etc. of the light source portion, at the joint, for example, the light source portion, together with the casing, is made removable from the arm, enabling a separation in small units. By this means, an easy replacement of the light source portion becomes possible, improving a maintainability.

(6) An illuminating device according to any one of (1) to (5), wherein at least one of the reflecting surfaces of the first reflector and the second reflector is formed into a satin-finished surface.

In this illuminating device, by light emerging from the light emitting device being reflected by the satin-like light emitting surface, a light diffusion effect is obtained, enabling, as well as an increase of an irradiated area, an irradiation of uniform illuminating light.

Advantage of the Invention

According to the illuminating device of the invention, as it includes: a light source portion including a first reflector having parabolic surfaces and a second reflector having flat plate-like reflecting surfaces; an arm which supports the light source portion on one end thereof; and a light source support which pivotably supports the other end of the arm, and an illumination direction is made freely changeable, it becomes possible to converge light from LED's with high efficiency without increasing an output of the LED's, and cause a high-illuminance illumination within an irradiated range, and it is possible to separate the irradiated area from a non-irradiated area with a clear boundary between them, and selectively illuminate a necessary desired area by excluding an area not desired to be illuminated. As a result, it becomes possible to use an illumination energy with high efficiency, making it possible not only to solve a light pollution problem, but also to contribute to a reduction in CO2 generation.

DESCRIPTION OF REFERENCE NUMERALS AND SIGNS

Figure 1:
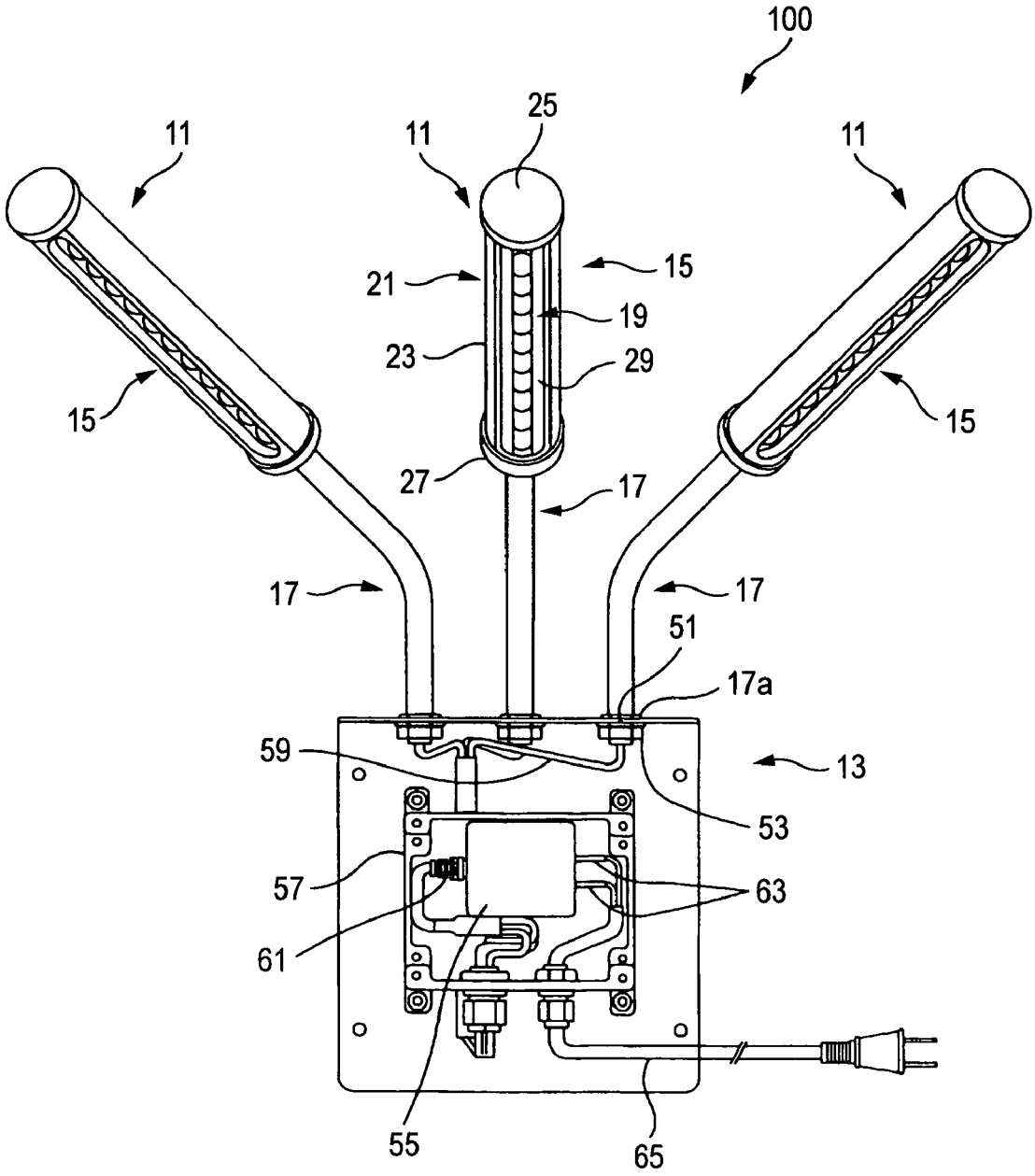
[FIG. 1] front view of an illuminating device according to the invention.

11 Lamp unit
13 Light source support
15 Light source portion
17 Arm
21 Casing
37 Joint
43 Transparent window
69 LED (light emitting diode)
79 First reflector
81 Second reflector
100 Illuminating device

BEST MODE FOR CARRYING OUT THE INVENTION

Hereafter, a detailed description will be given, with reference to the drawings, of a preferred embodiment according to the invention.

FIG. 1 is a front view of an illuminating device according to the invention.

An illuminating device 100 according to the embodiment has a light source support 13 provided with a plurality of lamp units 11. The lamp units 11 each include a light source portion 15 and an arm 17 which supports the light source portion 15 on one end thereof. The light source portion 15 includes an illuminating unit 19, to be described in detail hereafter, and a casing 21 which surrounds a periphery of the illuminating unit 19. The casing 21 includes a tube member 23 such as, for example, an aluminum pipe, and an end cap 25, which seals a leading end of the tube member 23, a connection cap 27, which seals a proximal end, and a transparent cover material 29 installed in a light irradiation window of the tube member 23.

Figure 2:
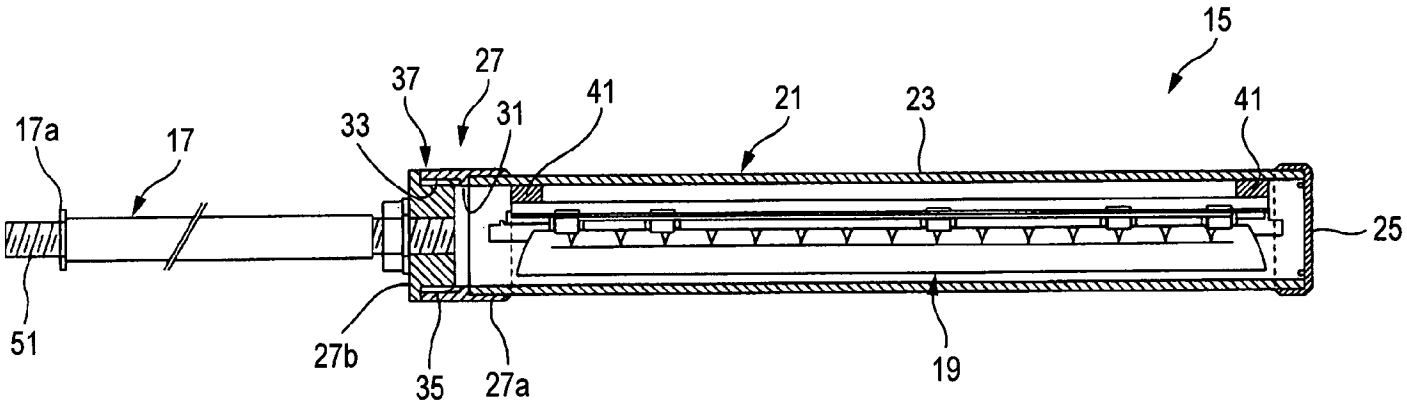
[FIG. 2] configuration of a lamp unit, representing a longitudinal sectional view of the lamp unit in (a) and a bottom view in (b)
Figure 2:
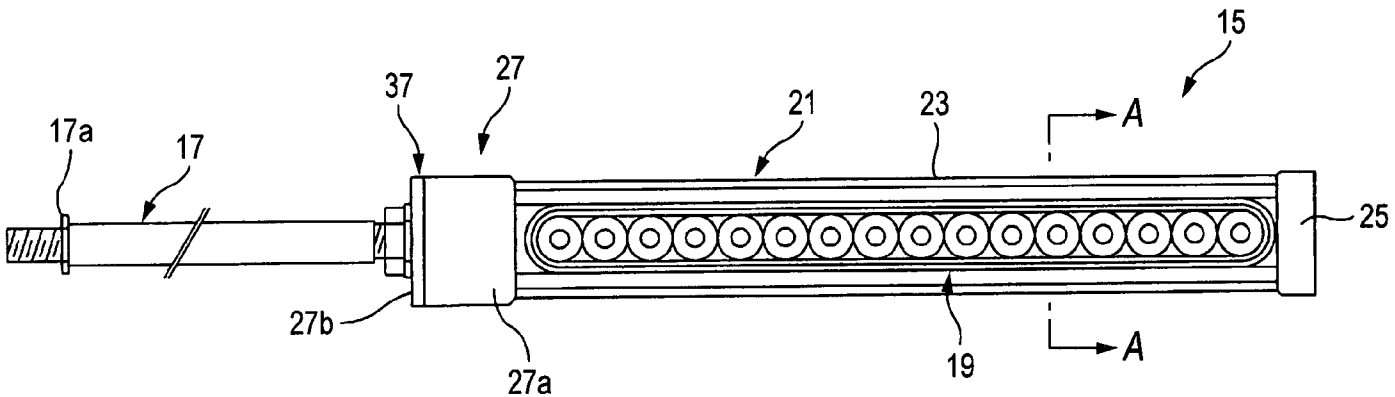

FIG. 2 is a configuration view, representing a longitudinal sectional view of the lamp unit in (a) and a bottom view in (b).

The end cap 25 is engaged on the leading end of the tube member 23 by screw or adhesive. The engagement portion between the end cap 25 and the tube member 23 is waterproof and dust-proof sealed by sealing. The connection cap 27 includes a ring material 27*a* and a cap 27*b*. A circumferentially continuing step 31 is projected in an axial center of an inner peripheral surface of the ring material 27*a*, and the proximal end of the tube member 23, inserted into an inner side from one end of the ring material 27*a*, abuts against the step 31. An outer periphery of the proximal end of the tube member 23 and an inner periphery of the ring material 27*a* are engaged with each other by screw or adhesive, and the engagement portion is waterproof and dust-proof sealed by sealing.

An internal thread 35 is formed on an inner periphery of the other end of the ring material 27*a*, and the ring material 27*a* is connected to the cap 27*b* by screwing an external thread 35, formed on an outer periphery of the cap 27*b*, on the internal thread 33. That is, the ring material 27*a* and the cap 27*b* configure a joint 37. The joint 37, by being screwed apart, is separated into the ring material 27*a* on the tube member 23 side and the cap 27*b* on the arm 17 side. By this means, the light source portion 15 and the arm 17 are removably connected. Consequently, when replacing a light emitting diode etc. of the light source portion 15, at the joint 37, for example, the light source portion 15, together with the casing 21, is made removable from the arm 17, enabling a separation in small units. As a result, an easy replacement of the light source portion 15 becomes possible, thus improving a maintainability.

Figure 3:
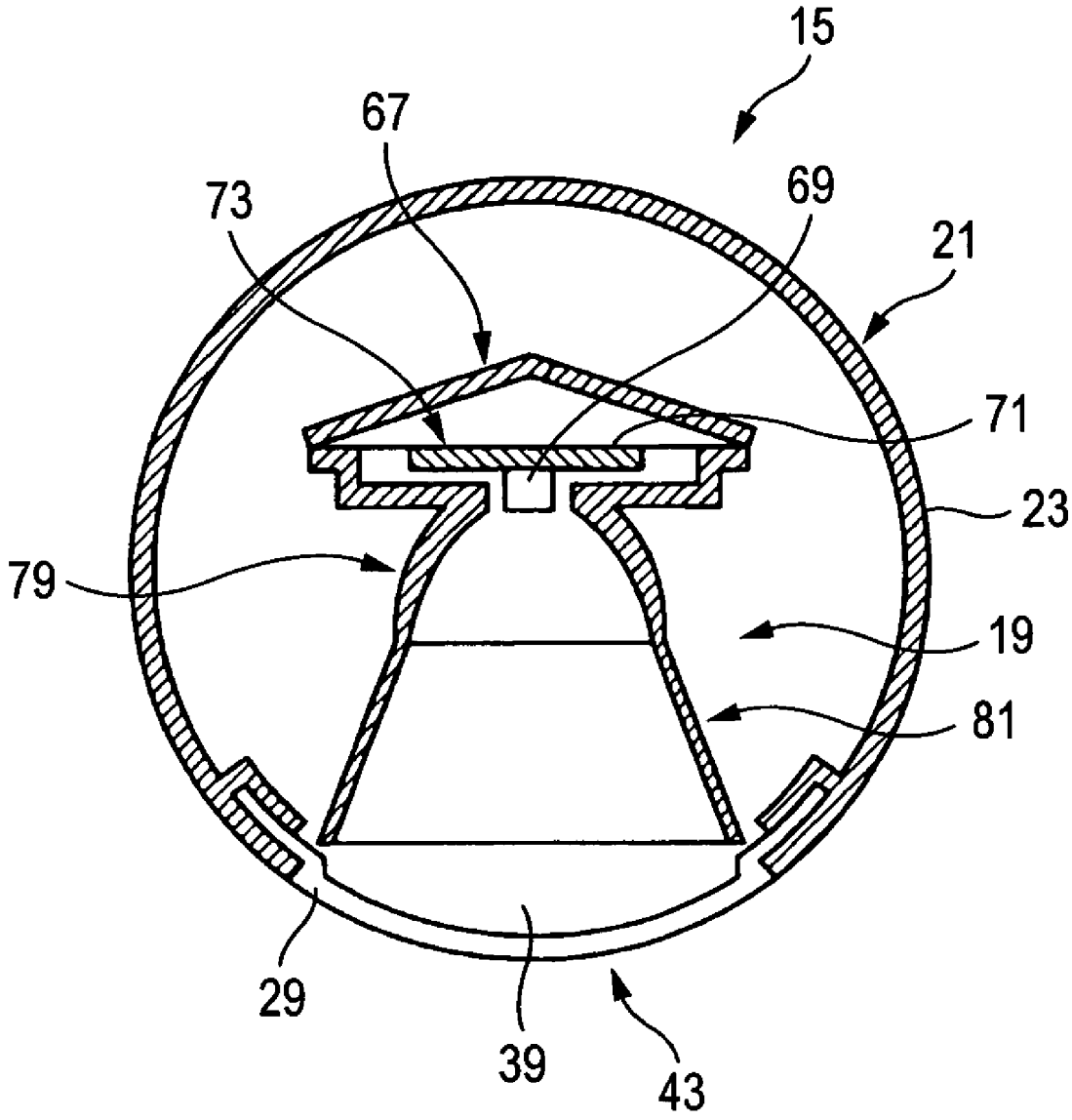
[FIG. 3] A sectional view taken along line A-A of FIG. 2(*b*)

FIG. 3 is a sectional view taken along line A-A of FIG. 2(*b*).

The tube member 23 incorporating the illuminating unit 19 has the transparent cover material 29 attached to a light emergence opening 39 of the illuminating unit 19. Consequently, the casing 21 is formed with a slit-like transparent window 43 made of the transparent cover material 29, and the light emergence opening 39 is disposed in the transparent window 43.

By the light source portion 15 being surrounded with the casing 21 in this way, it becomes possible to cause illuminating light to emerge from the transparent window 43 while blocking an effect of wind and rain. By this means, while an emergence of high-illuminance illuminating light is being secured, a weatherability is increased, and a durability is improved.

At this point, a detailed description will be given of a structure of the joint 37.

Figure 4:
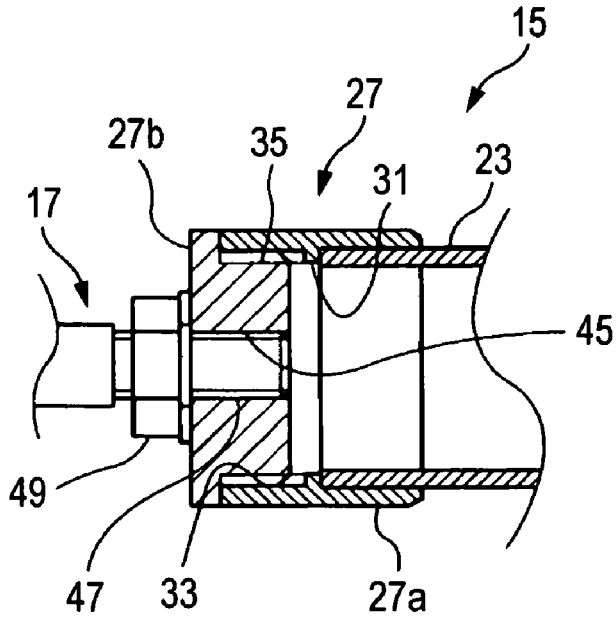
[FIG. 4] An illustration of a connection of an arm and a joint, representing a connected condition in (a) and a removed condition in (b)
Figure 4:
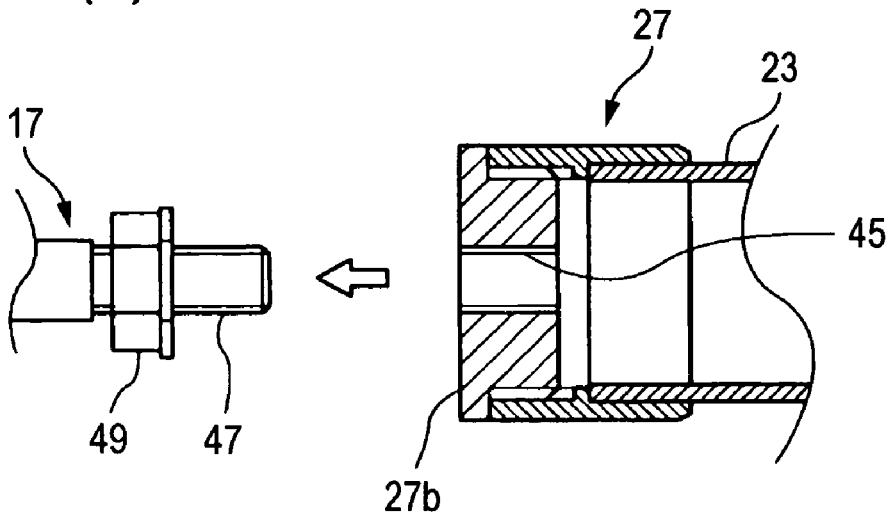

FIG. 4 is an illustration of a connection of the arm and the joint, representing a connected condition in (a) and a removed condition in (b).

An internal thread 45 is formed on the cap 27*b* of the joint 37. An external thread 47 is formed on the leading end of the arm 17. Also, an emergence angle adjustment nut 49 is threaded together with the external thread 47 on the leading end of the arm 17. The light source portion 15, by the external thread 47 of the arm 17 being threaded together with the internal thread 45 of the cap 27, is supported by and secured to the leading end of the arm 17. At this point, the light source portion 15, by the emergence angle adjustment nut 49 being fastened to the cap 27*b* side at an arbitrary rotation angle of the light source portion 15 with respect to the arm 17, is regulated as to its rotation, and secured to the leading end of the arm 17 in a desired rotation direction.

In this way, as the light source portion 15 is supported in such a way as to be pivotable with respect to an axis of the arm 17, and has its light irradiation direction made variable as it pivots, emergent directional illuminating light is oriented in an arbitrary direction.

Although, as described heretofore, the arm 17 and the light source portion 15 are made connectable and disconnectable by means of the ring material 27*a* and the cap 27*b* at the joint 37, it is also acceptable that they are connectable and disconnectable by means of the cap 27*b* and the leading end of the arm 17.

A flange 17*a* (refer to FIG. 2) is formed at a proximal end of the arm 17. As shown in FIG. 1, an arm securing hole 51, which is larger than an external diameter of the proximal end of the arm 17 and smaller than an external diameter of the flange 17*a*, is bored in an upper surface of the light source support 13 formed in a box shape. Also, an external thread 52 is formed on the proximal end of the arm 17. Consequently, the proximal end of the arm 17 is inserted in the arm securing hole 51 and, by an attachment nut 53 being threaded together with a leading end of the proximal end, the flange 17*a* and the attachment nut 53 clamp a periphery of the arm securing hole 51, thereby securing the arm 17 to the light source support 13. Then, the light source support 13 is configured in such a way that, after loosening the attachment nut 53 and pivoting (revolving) the arm 17 in a desired direction, by fastening the attachment nut 53, it is possible to support and secure the proximal end of the arm 17 at an optional pivotal angle.

The light source support 13 has a drive unit 55, to be described hereafter, housed inside a waterproof casing 57. A feeder cable 59 connected to the illuminating unit 19 is inserted through the arm 17, led into the waterproof casing 57, and connected to a second side output terminal 61 of the drive unit 55. A power wire 65, being connected to a first power terminal 63 of the drive unit 55, passes through the waterproof casing 57, and is led out to an exterior of the light source support 13.

In the illuminating device 100, a plurality (in the embodiment, three as an example) of the lamp units 11, each of which includes the light source portion 15 and the arm 17 supporting the light source portion 15, is supported on the light source support 13. By the illuminating device 100 being equipped with the plurality of lamp units 11, it is possible to increase an illuminated area. Also, by rotating the arms 17 and causing the illuminated areas to overlap, it is possible to form an optional illumination pattern in which a high-illuminance illuminated range is disposed in a desired position.

Next, a description will be given of the illuminating unit 19.

Figure 5:
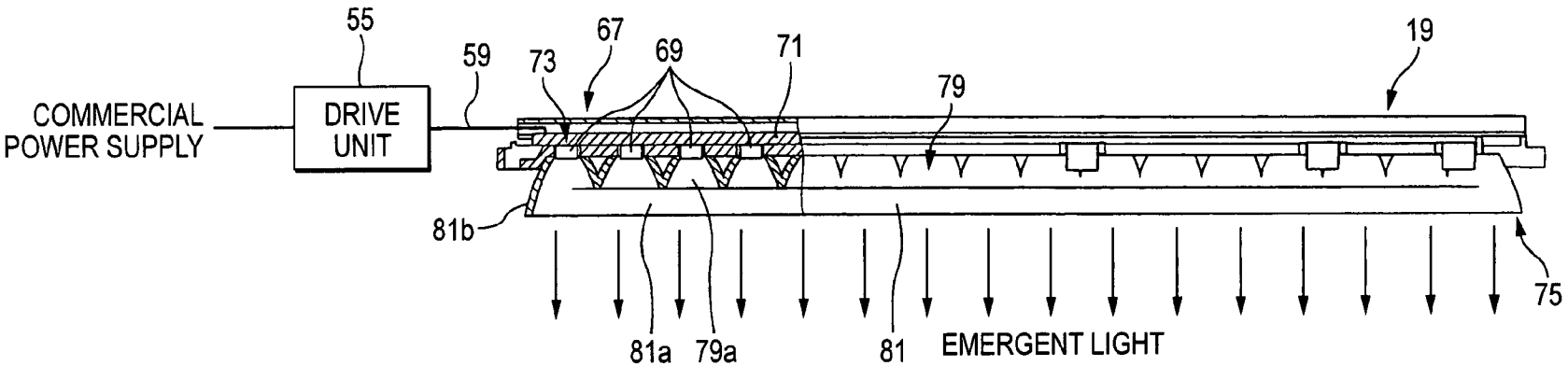
[FIG. 5] An overall configuration view showing a light source portion of the illuminating device according to the invention.

FIG. 5 is an overall configuration view of the light source portion of the illuminating device according to the invention.

The drive unit 55 is connected to the illumination unit 19. The drive unit 55, being for supplying the illuminating unit 19 with a light emission drive power, can use, for example, a full-range transformer. The drive unit 55, being connected to a commercial power supply, converts an electric power of, for example, AC110V to 220V, 50 Hz to 60 Hz from the commercial power supply, into a drive voltage of DC12V (an optional voltage of, for example, DC6V or DC24V, or an alternating current is also acceptable) and supplies it to the illuminating unit 19.

The illuminating unit 19 is configured to include a rear plate 67, a light emitter 73 having a multiplicity of LED's 69 linearly arranged on a wiring board 71 which is a base, and a reflecting mirror member 75. The rear plate 67, with the wiring board 71 sandwiched between it and the reflecting mirror member 75, is removably attached to the reflecting mirror member 75.

Figure 6:
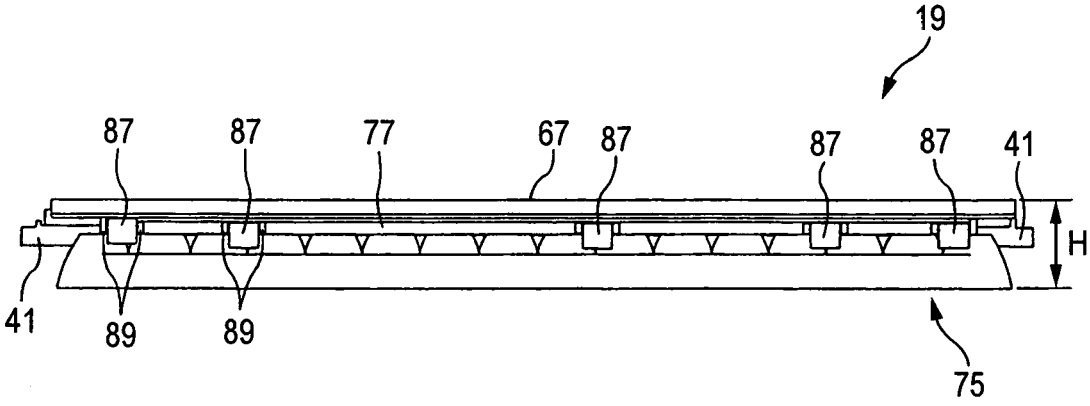
[FIG. 6] A side view (a) and a bottom view (b) of an illuminating unit.
Figure 6:
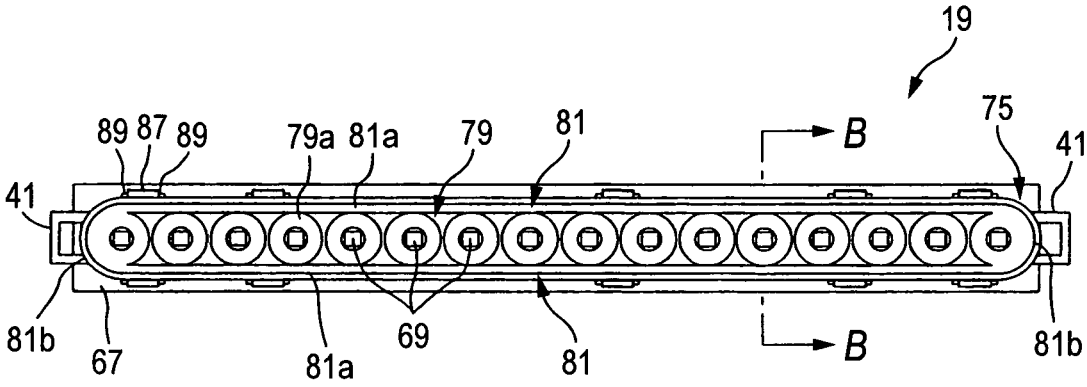
Figure 7:
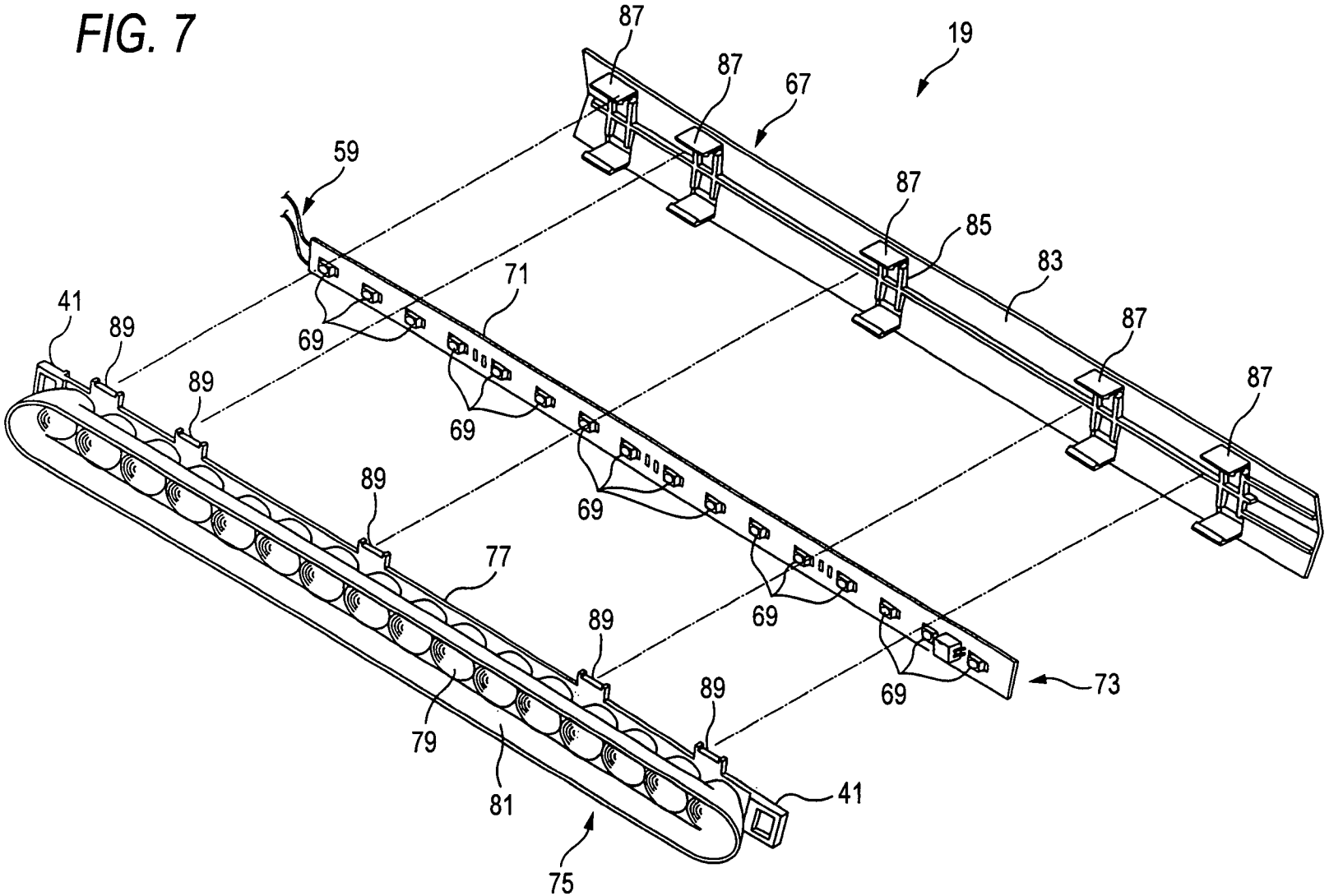
[FIG. 7] An exploded perspective view of the illuminating unit.

FIG. 6 shows a side view (a) and a bottom view (b) of the illuminating unit, and FIG. 7 shows an exploded perspective view of the illuminating unit.

As shown in FIG. 6(*a*), the illuminating unit 19 has a height H in a condition in which the rear plate 67 is attached to the reflecting mirror member 75. The height H is largely in the order of 20 mm in the embodiment, and the thickness is drastically reduced as compared with a case in which a incandescent lamp, a fluorescent lamp or the like is used as a light source. In the event that the height H is too small, deflection characteristics of the reflecting mirror member 75 are impaired while, in the event that it is too large, an installation space is required, preventing an enhancement of a disposition freedom of the illuminating unit 19. For this reason, it is desirable that the height H is in the order of 15 to 30 mm, particularly, in the order of 20 to 23 mm.

The reflecting mirror member 75 integrally includes a long plate-like attachment base 77 (refer to FIG. 7), a first reflector 79 formed with a plurality (in the embodiment, a total of 16) of parabolic reflecting surfaces (parabolic mirrors) 79*a* each of which is connected to the attachment base 77 and, as shown in FIG. 6(*b*), having an opening in a center position, opens to a light emergence side, and a second reflector 81 which, being provided farther to the light emergence side than the first reflector 79, is formed with a flat plate-like reflecting surface (a planar mirror) 81*a* parallel to an array direction of the parabolic mirrors 79*a*. The second reflector 81 being formed with a pair of the planar mirrors 81*a* in a direction perpendicular to the array direction of the parabolic mirrors 79*a*, both ends on each side in the array direction are connected by a parabolic wall 81*b* formed by extending a parabolic mirror of the first reflector 79. The reflecting mirror member 75 is a resin molding integrally molded by injection molding, and at least light reflecting surfaces of the first reflector 79 and the second reflector 81 are mirror coated by aluminum evaporation or the like. Also, without being limited to this, it is possible to use another common practice as the light reflecting surface.

As shown in FIG. 7, the rear plate 67 includes a shade 83 having a dogleg shape in vertical section, a rib 85 supporting a back side of the wiring board 71 on an inner surface of the shade 83, and locking claws 87 which, engaging with the reflecting mirror member 75, are installed at a plurality (in the embodiment, five) of points in a longitudinal direction of the shade 83. The locking claws 87 are formed as a pair of upper and lower hooks, as seen in the figure, combining into a squared U-shape in vertical section.

The wiring board 71 is, for example, a printed-wiring board, and a plurality (herein, 16) of LED's 69 corresponding to the individual parabolic mirrors 79*a* are linearly mounted on the reflecting mirror member 75 side in a longitudinal direction of the wiring board 71. Then, the feeder cable 59 is led out from one end of the wiring board 71 and connected to the drive unit 55 (refer to FIG. 1). As the wiring board 71 is a one side mounting module, it is a safe module in which it is easy to find a problem in case of trouble and which has an excellent maintainability.

The reflecting mirror member 75 has a bracket 41 for securing the illuminating unit 19 formed at each end of the attachment base 77 formed as a long flat plate, and has engagement portions 89, with which are engaged the locking claws 87 of the rear plate 67, provided perpendicularly to a longitudinal direction of the attachment base 77. The reflecting mirror member 75, the wiring board 71 and the rear plate 67 are removably fitted together by a snap engagement of the engagement portions 89 with the locking claws 87 of the rear plate 67 in such a way that the wiring board 71 is sandwiched between the reflecting mirror member 75 and the rear plate 67.

When the reflecting mirror member 75, the wiring board 71 and the rear plate 67 are fitted together, light emitting faces of the LED's 69 are positioned in focal positions of the parabolic mirrors of the first reflector 79. In this case, that is, surfaces abutting against a surface of the wiring board 71 are discretely disposed on the reflecting mirror member 75, and the abutment surfaces are formed to have a height at which the light emitting faces of the LED's 69 fall in the focal positions of the parabolic mirrors. Also, when the wiring board 71 is housed in a board housing position formed in the reflecting mirror member 75, a height of the rib 85 of the rear plate 67 is set in such a way that the rib 85 presses the wiring board 71 against the abutment surfaces.

Consequently, simply by fitting the reflecting mirror member 75, the wiring board 71 and the rear plate 67 together, the focal positions of the parabolic mirrors and the light emitting faces of the LED's 69 match with ease and high accuracy. By this configuration, it is possible to facilitate attachment without using fastening means such as, for example, a screw, reduce a number of parts, and ease a process for assembly and adjustment, improving a productivity.

Next, a description will be given of optical characteristics of the heretofore described configuration with respect to the illumination unit 19.

Figure 8:
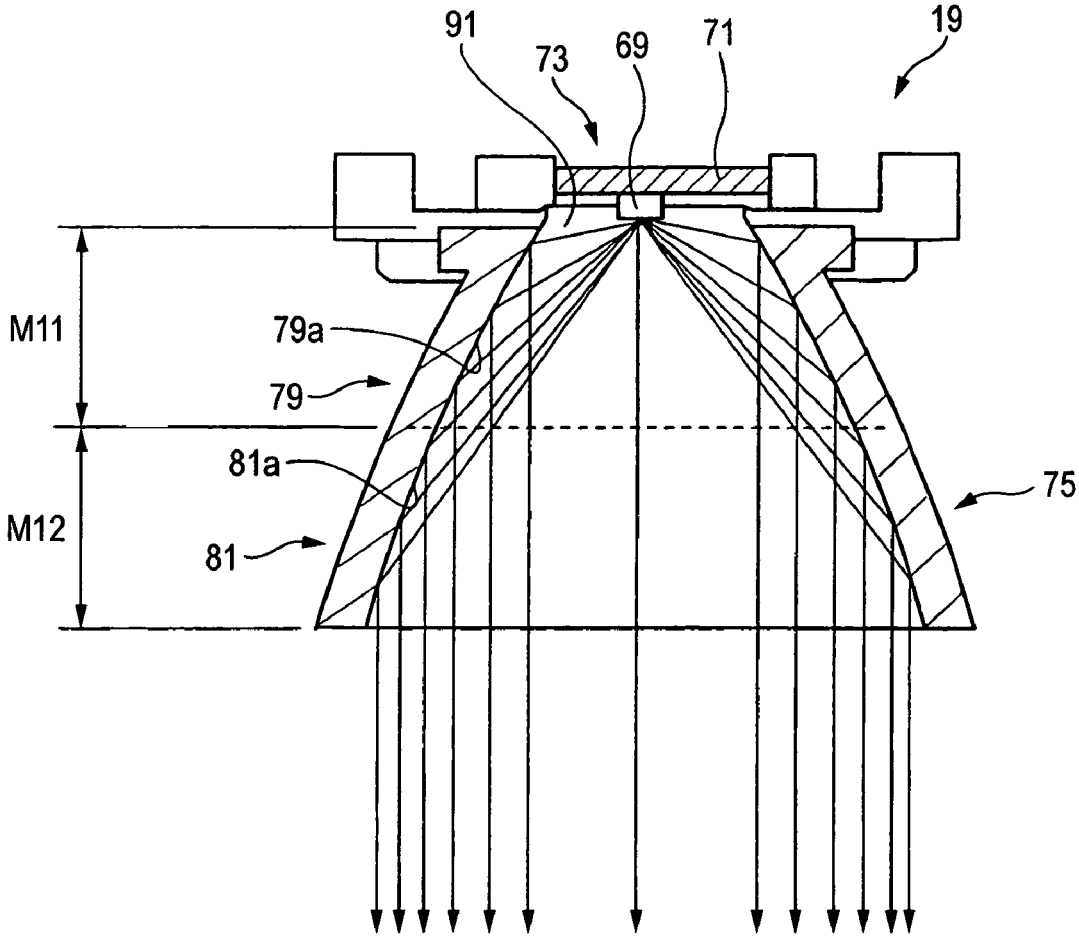
[FIG. 8] A sectional view of the illuminating unit shown in FIG. 6 taken along line B-B thereof.

FIG. 8 is a sectional view of the illumination unit shown in FIG. 6 taken along line B-B thereof.

The reflecting mirror member 75 of the illuminating unit 19 has the first reflector 79 and the second reflector 81 continuously formed, and a proximal end of the first reflector 79 is provided with an opening 91 for disposing the light emitting face of the LED 69 in the focal position of the parabolic mirror 79*a*. The parabolic mirror 79*a* of the first reflector 79 has a parabolic reflecting surface with the light emitting face of the LED 69 as a focal position, and reflects light from the LED 69 toward the light emergence side while making the light approximately parallel.

Also, the second reflector 81, being provided farther to the light emergence side than the first reflector 79, includes the flat plate-like planar mirror 81*a* disposed parallel to the array direction of the parabolic mirrors 79*a*, that is, the array direction of the LED's 69. Then, the second reflector 81 receives light from the LED 69, which has not been projected onto the first reflector 79, and reflects it toward the light emergence side while making it approximately parallel. As the first reflector 79 has a predetermined reflecting surface area M1, and the second reflector 81 has a predetermined reflecting surface area M2 contiguous with the reflecting surface area M1, the light reflected by the first and second reflectors 79 and 81 is converted into parallel light of a large light quantity, and the parallel light is projected onto an illuminated subject.

A gradient angle of the planar mirror 81*a* with respect to an optical axis of the LED 69 is set at an angle at which a luminous flux from the LED 69, which has not been projected onto the first reflector 79, is converted into parallel light. In the case of the embodiment, the gradient angle is set within a range of 20° to 27° with respect to the optical axis of the LED 69.

At this point, the LED 69 has a wide illuminance angle such as, for example, 120° and, even though laterally emerging optic components increase from among the emergent light, as they are caught by the first reflector 79 and the second reflector 81, a proportion contributing to light parallelization is heightened. By this means, an illuminance distribution equalization effect is further enhanced.

Next, a description will be given of the illuminance distribution by the illuminating unit 19 of the heretofore described configuration.

Figure 9:
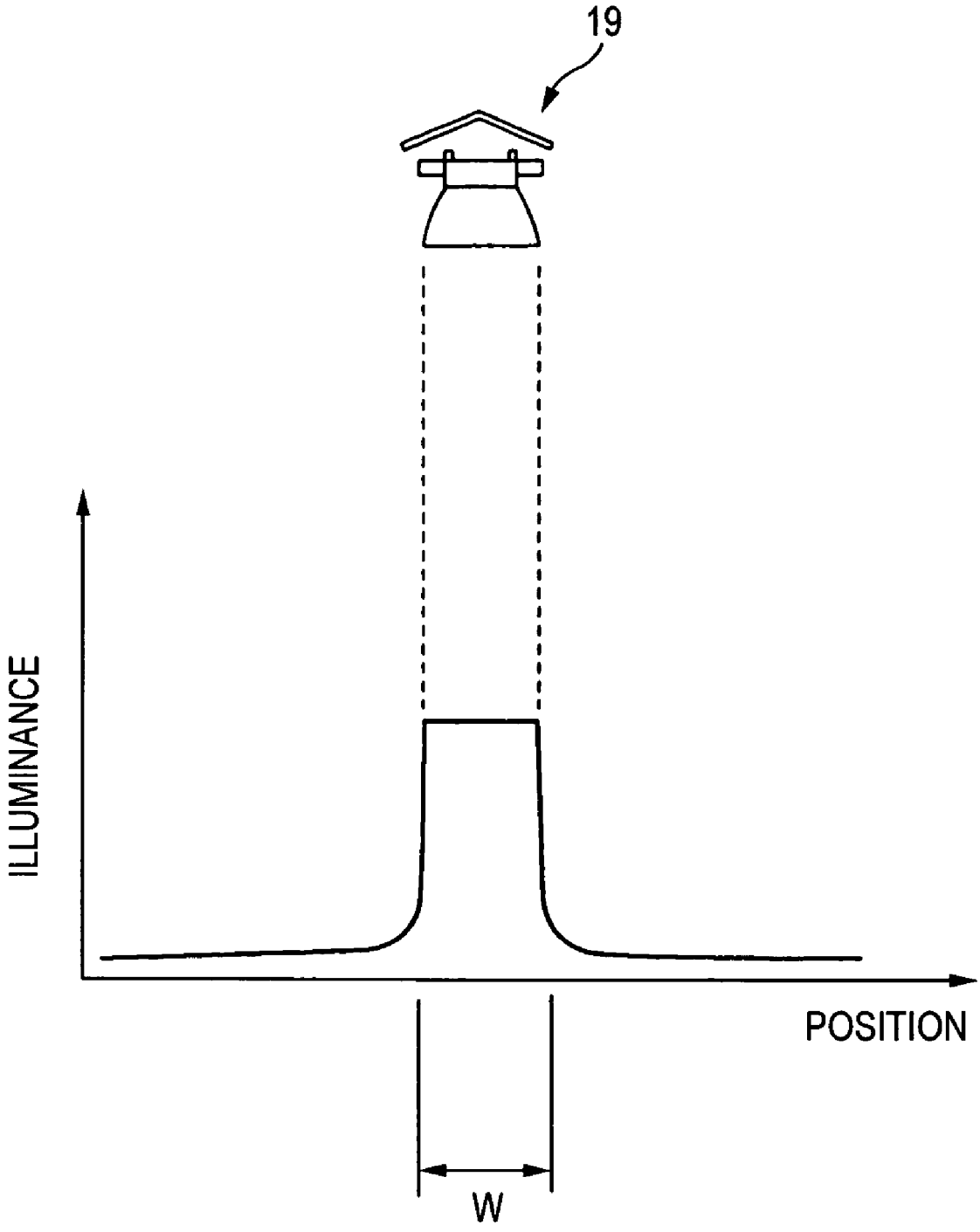
[FIG. 9] A graph showing an illuminance distribution by the illuminating unit.

FIG. 9 is a graph showing the illuminance distribution by the illuminating unit.

As shown in FIG. 9, when a light quantity in a range W, which includes an optic component directly projected from the LED 69 and an optic component having arrived through a reflection by the first reflector 79 and the second reflector 81, is compared with that in any other area, a boundary between them appears clearly. This is for the reason that light is converged in the range W, and a luminous flux is converted into approximately parallel light, and that an irradiance is in a high condition.

Also, the light emitting face of the LED 69 is in a center of an element of the LED 69, and projects an image onto a whole surface of the parabolic mirror 79*a* of the first reflector 79. Also, the light emitting face also projects a light emitting face image onto both planar mirrors 81*a* and 81*a* of the second reflector 81. That is, although the optic component directly projected from the LED 69 is widened by the action of diffusion in the event of the first reflector 79 alone, the diffusing and widening optic component is deflected and converted into parallel light by the planar mirrors 81*a* of the second reflector 79. By this action, an irradiance of a luminous flux obtained is heightened, making it possible to effectively equalize the illuminance distribution in the range W and, as a result, the boundary of the range W becomes clearly visible.

Next, a description will be given of a property of the light source portion 15 of the illuminating device 100.

Figure 10:
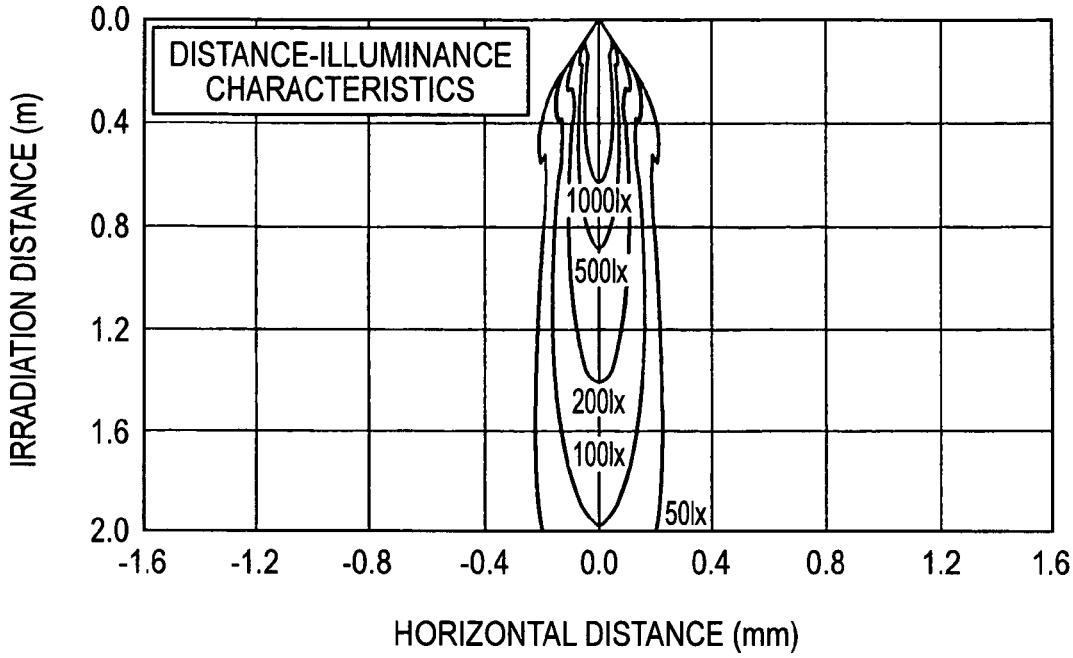
[FIG. 10] A graph representing a correlation between an irradiation distance and a horizontal distance of illuminance characteristics.
Figure 11:
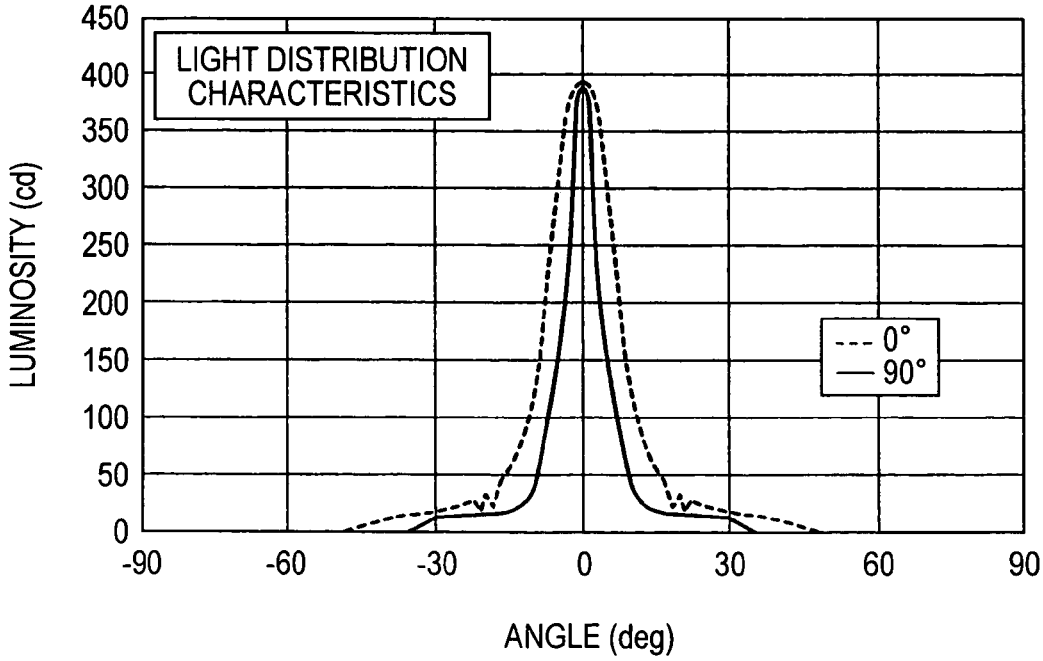
[FIG. 11] A graph representing a correlation between a luminosity and an angle of light distribution characteristics.
Figure 12:
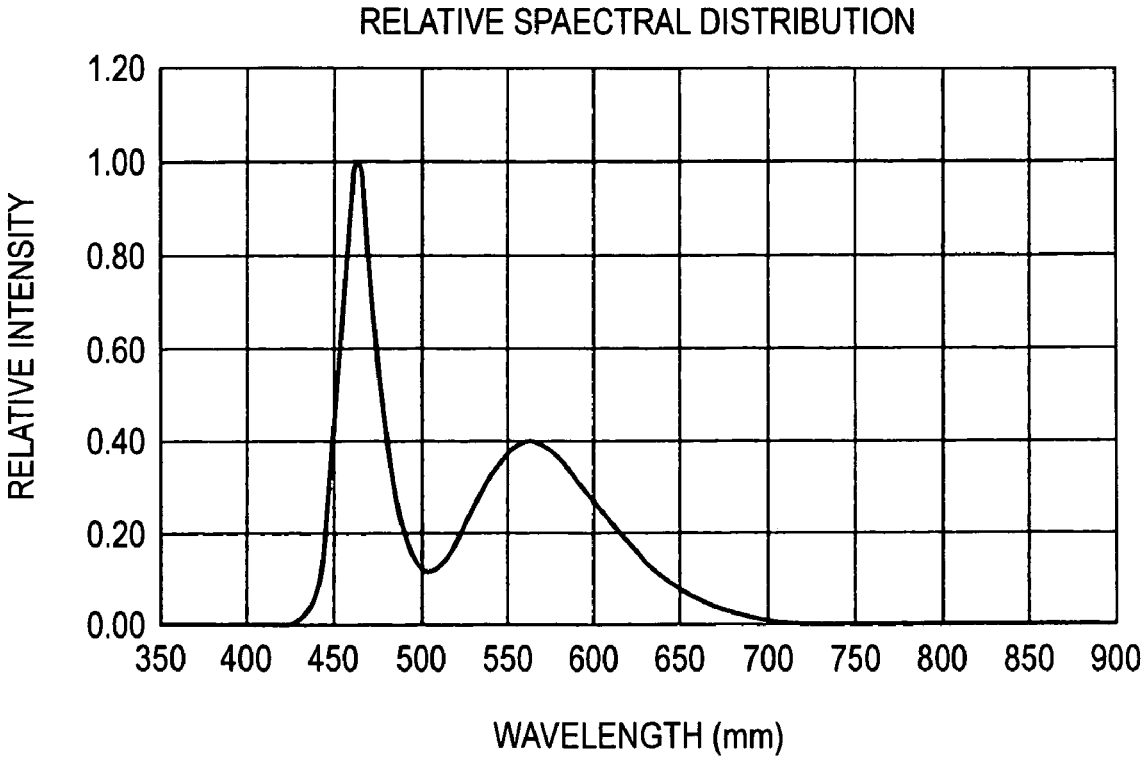
[FIG. 12] A graph representing a correlation between a relative intensity and a wavelength of a relative spectral distribution.

FIG. 10 is a graph representing a correlation between an irradiation distance and a horizontal distance of illuminance characteristics, FIG. 11 a graph representing a correlation between a luminosity and an angle of light distribution characteristics, and FIG. 12 a graph representing a correlation between a relative intensity and a wavelength of a relative spectral distribution. In FIG. 11, an angle on a horizontal axis describes a result of a symmetrical rotation through an angle of 90 degrees around a central axis of the light emitting face of the illuminating unit 100 with respect to a measuring instrument, where a solid line represents a result of a measurement with an axis parallel to a longitudinal direction of the lamp unit 11 as a rotation axis, and a broken line represents a result of a measurement with an axis in a direction perpendicular to the rotation axis as a rotation axis.

A number of LED's 16

An outside dimension of the reflecting mirror member 75 23.8 mm in length, 264 mm in width, 16.25 mm in height (H)

According to the light source portion 15 of the heretofore described configuration, the following basic characteristics are obtained by experiment.

A linear irradiation distance (a maximum distance from a light source position to a position in which an illuminance of 1 lx or more can be obtained)

30 m or more

A sub-lightspot illuminance (an illuminance at a point located a distance of 2 m immediately beneath a light spot)

About 50 lx/m$^2$

Electrical characteristics

At the time of 12V drive (DC) 0.09 A 1.1 wh/unit

At the time of 24V drive (DC) 0.08 A 1.92 wh/unit

Optical characteristics

All luminous fluxes (at the time of 12V drive) 43.3 lm

All luminous fluxes (at the time of 24V drive) 48.8 lm

Particularly, as the sub-lightspot illuminance at the point located a distance of 2 m immediately beneath the light spot, as shown in FIG. 10, about 50 lx/m$^2$ is obtained in an irradiated range of a vertical distance of 0.4 m (a distance in a direction perpendicular to an axis of the casing 21).

As for the light distribution characteristics, as shown in FIG. 11, an area of a luminosity of 50 to 380 cd is obtained at a rotation angle range of −10 to 10° around an axis of the light source portion 15.

In the relative spectral distribution, as shown in FIG. 12, a light having a blue wavelength range of 450 to 480 nm and a light having a yellow wavelength range centered around 560 nm are obtained with a high intensity, and a white light is generated by these lights. According to this, as light having a waveband of 365 nm to 410 nm which insects favor is not included, it is possible to realize a street light which is difficult for insect pests such as moths and mosquitoes to approach.

Next, a description will be given of a use aspect of the illuminating device 100.

Figure 13:
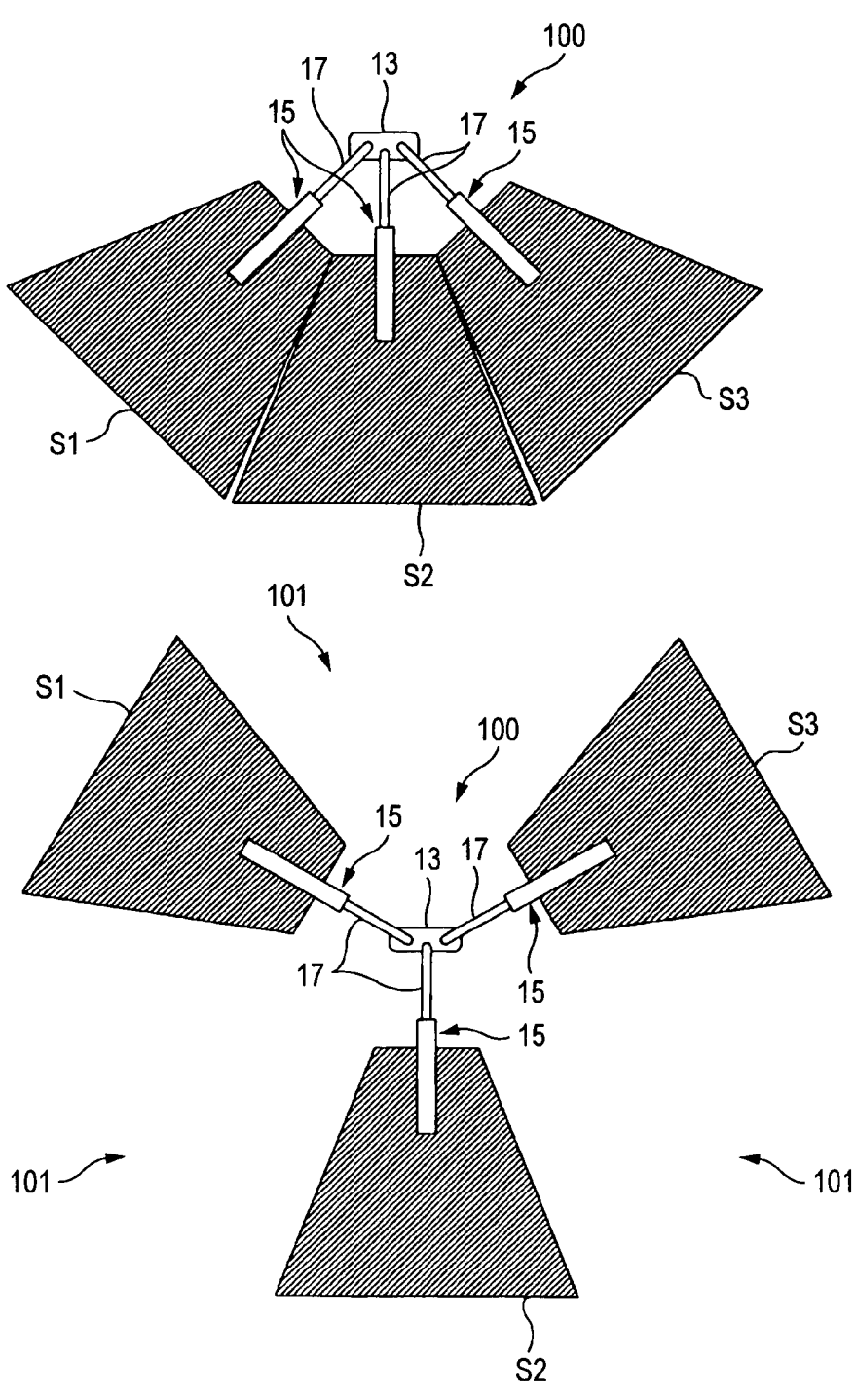
[FIG. 13] An illustration representing different irradiated areas obtained by a pivoting of the arms as (a) and (b)

FIG. 13 is an illustration representing different irradiated areas obtained by a pivoting of the arms as (a) and (b).

In the illuminating device 100 according to the heretofore described embodiment, as shown in FIG. 13(*a*), by setting a rotation angle of the arms 17, in such a way that irradiated areas S1, S2 and S3 continue, in accordance with a height of the light source portion 15 from the ground, light from the LED's 69 are converged with high efficiency without increasing an output of the LED's 69, enabling a high-illuminance illumination within the irradiated areas S1, S2 and S3.

Also, as shown in FIG. 13(*b*), by rotating the arms 17, it becomes possible to separate the irradiated areas S1, S2 and S3 from non-irradiated areas 101 with clear boundaries between them, making it possible to selectively illuminate a necessary desired area by excluding an area not desired to be illuminated.

Figure 14:
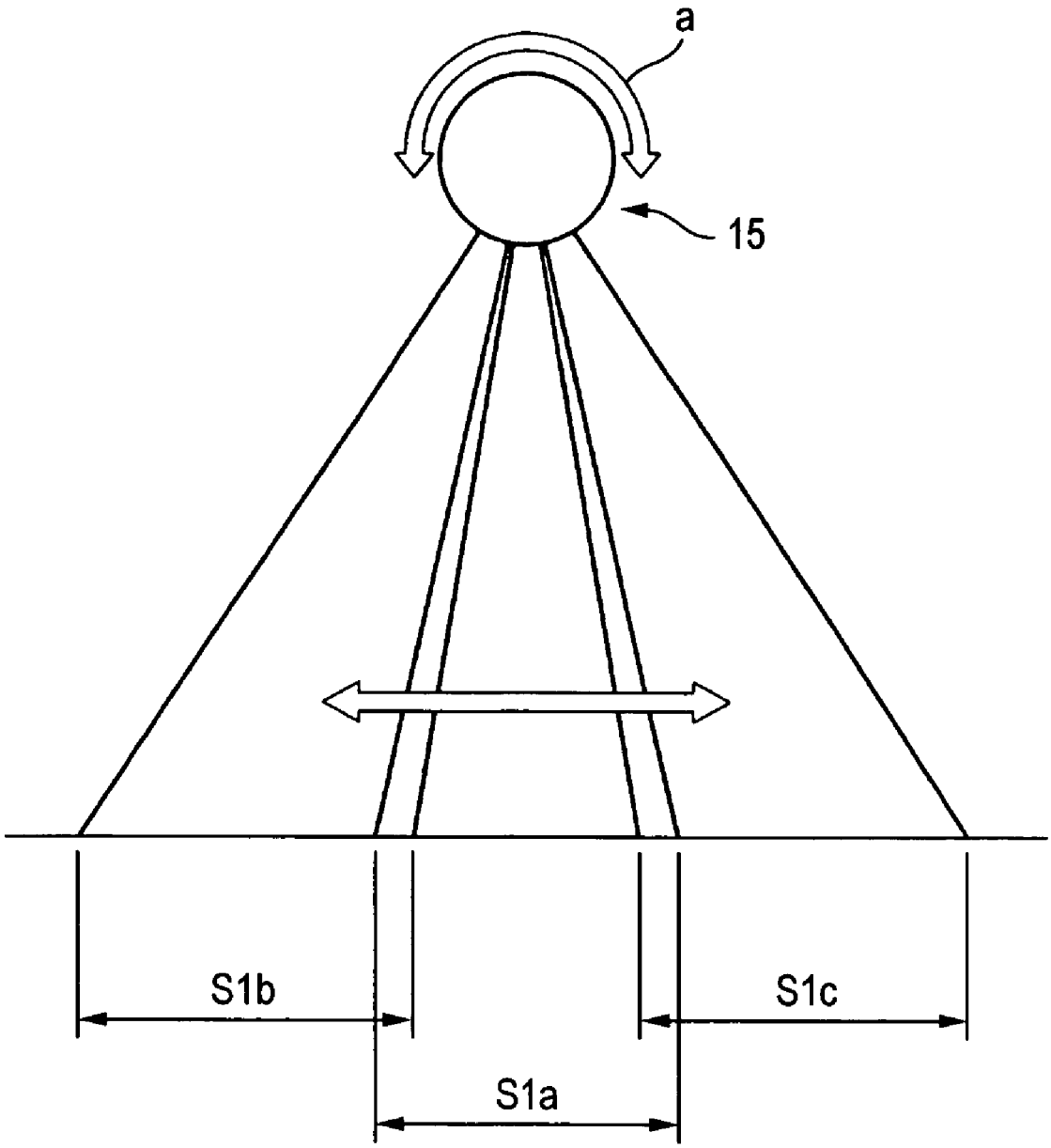
[FIG. 14] An illustration representing a change of an irradiated area by a pivoting around an axis of the light source portion.

FIG. 14 is an illustration representing a change of an irradiated area by a pivoting around the axis of the light source portion.

As shown in FIG. 14, by the light source portion 15 being pivoted in a direction around the axis thereof with respect to the arm 17 (in a direction of arrow ain FIG. 14), a light irradiation direction changes from side to side in the same figure. By this means, emergent directional illuminating light is oriented in an optional direction, making it possible to change the irradiated area S1 to an irradiated area S1*a*, S1*b* or S1*c*.

Figure 15:
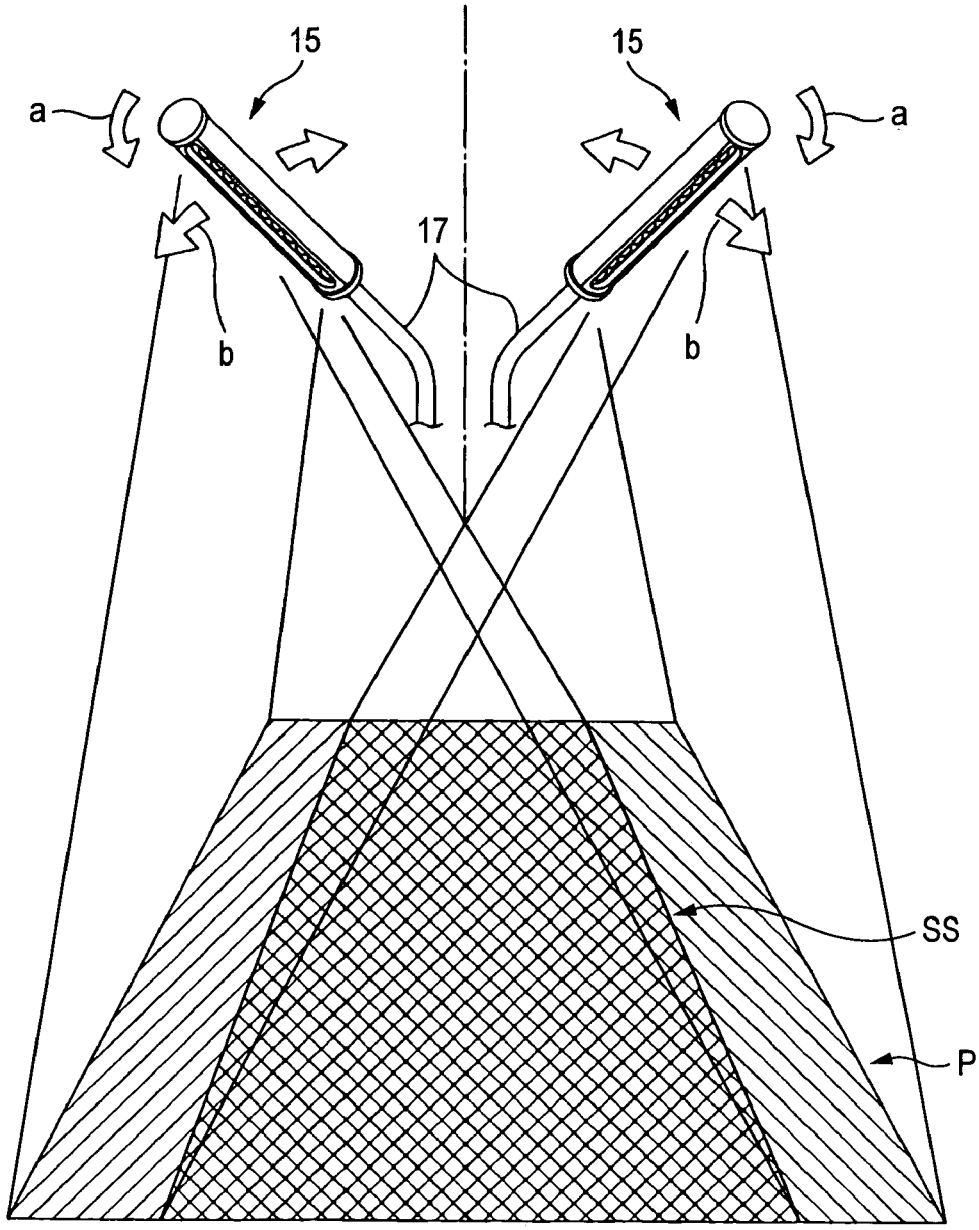
[FIG. 15] An illustration representing how an irradiated area is set.

FIG. 15 is an illustration representing how an irradiation area is set.

After the arms 17 are revolved at their proximal ends in a direction of arrow b and placed in the irradiation condition shown in FIG. 13(*a*), by pivoting the light source portions 15 in a direction of awith respect to the axes of the arms 17, it is possible to overlap the irradiated areas S1 and S2 and form an optional irradiation pattern P in which a high-illuminance irradiated range SS is disposed in a desired position.

Figure 16:
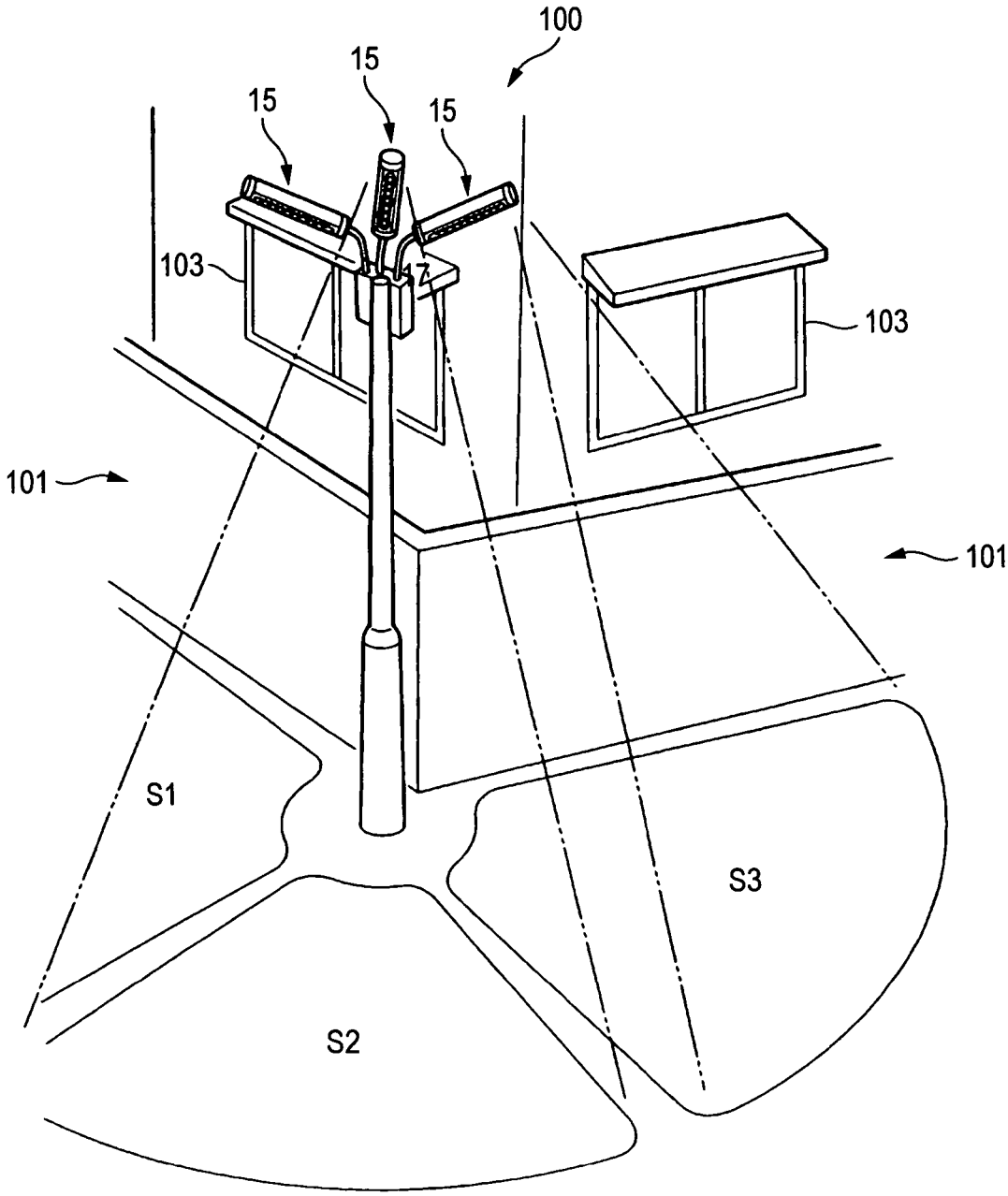
[FIG. 16] An illustration representing an example of an irradiated area in a case in which the illuminating device according to the invention is used as a street light.

FIG. 16 is an illustration representing an example of an irradiated area in a case in which the illuminating device according to the invention is used as a street light.

In a case of a hitherto known street light, it is difficult to selectively set an area to be illuminated but, in the case of the illuminating device of the invention, it can easily be set.

When using an irradiation direction flexibility of the illuminating device 100, as shown in FIG. 16, it is possible to separate the irradiated areas S1, S2 and S3 from the non-irradiated areas 101 with clear boundaries between them, and selectively illuminate a desired area (the irradiated areas S1, S2 and S3) by excluding an area not desired to be illuminated (the non-irradiated areas 101). In a case of installing a street light in a proximity of a residence, it is necessary to consider that mainly a road surface is irradiated and the residence suffers no glare. However, according to the illuminating device 100, all light from the light source portion 15 is effectively used, preventing the light from leaking and illuminating a neighboring building, thus eliminating even a need to bother drawing down a lighttight curtain or a blind due to the fact that illuminating light enters a bedroom or a living room from a window 103.

Figure 17:
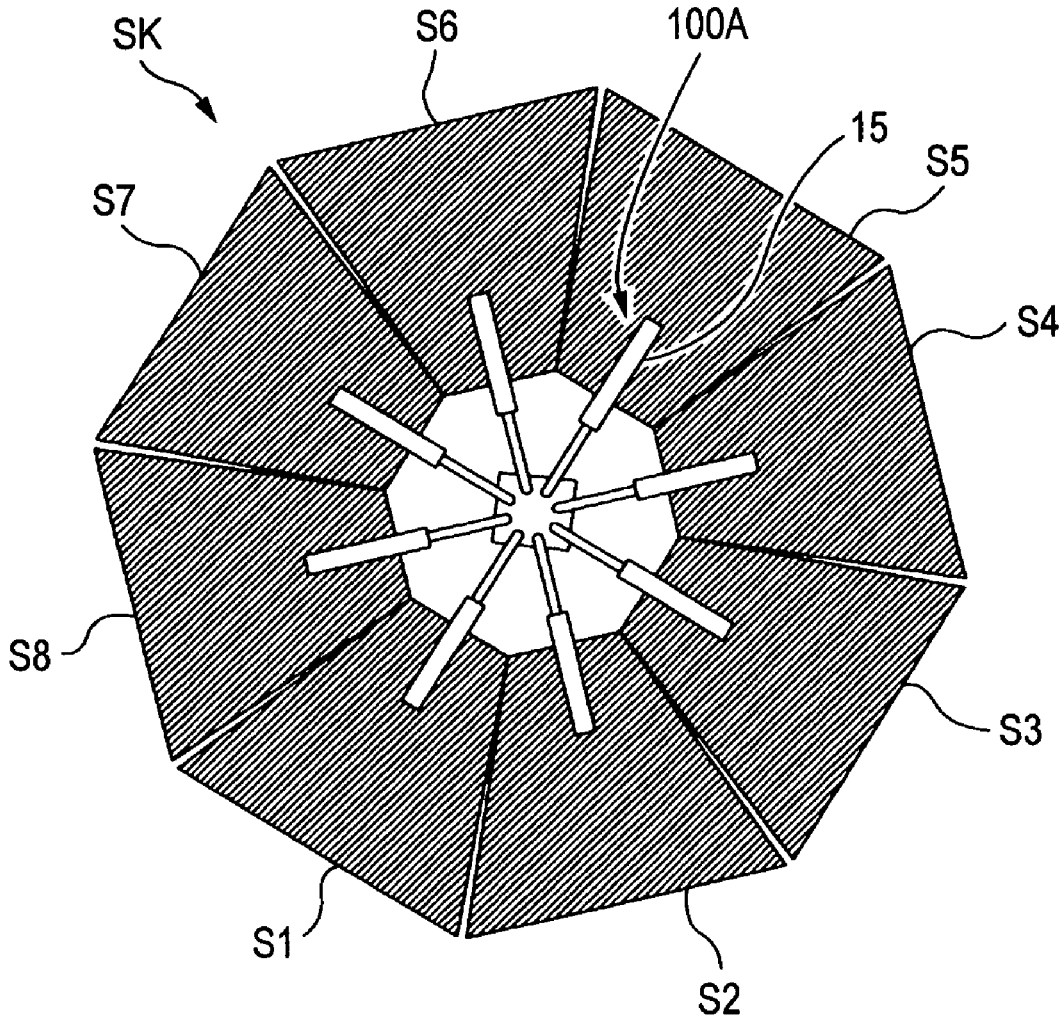
[FIG. 17] An illustration of an example in which more light source portions are added, forming an annular irradiated area.

FIG. 17 is an illustration of an example in which more light source portions are added, forming an annular irradiated area.

Also, the illuminating device 100 can be configured of three or more light source portions 15 in accordance with installation conditions. As shown in FIG. 17, it is also acceptable that the light source portions 15 are radially arranged in such a way that illumination areas S1, S2, S3, S4, S5, S6, S7 and S8 continue. With such a configuration, an annular irradiated area SK can be formed below an illuminating device 100A.

In the above description, a description is given of an example in which the illuminating device of the invention is used as mainly a street light, but the illuminating device is not limited to this, and can also be used for indoors.

Figure 18:
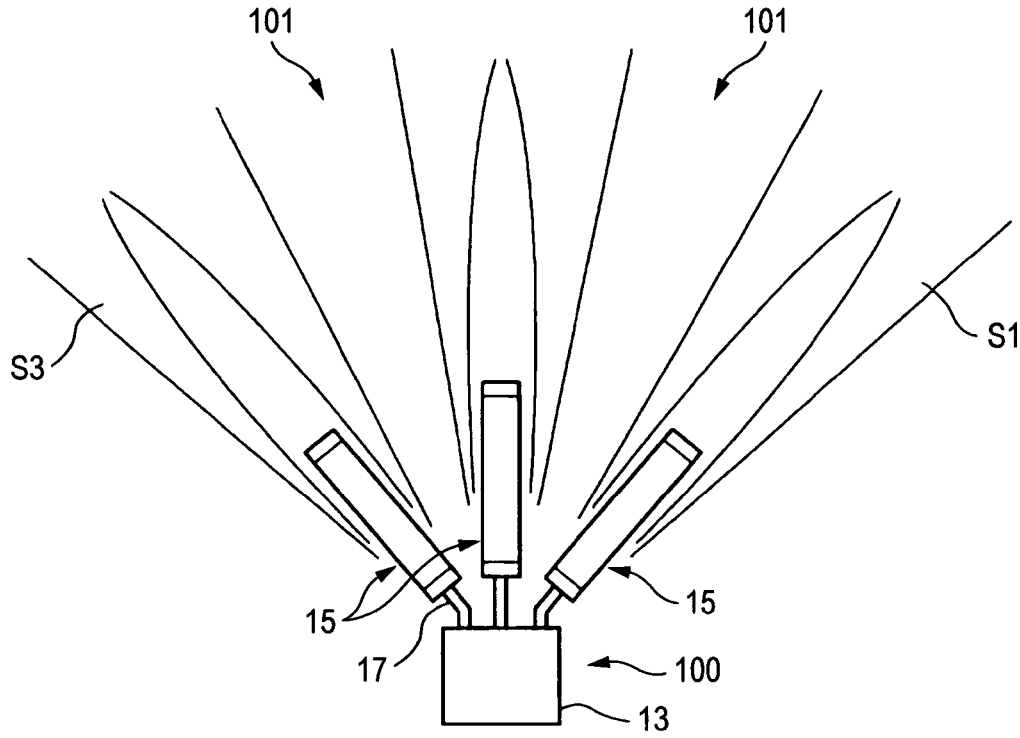
[FIG. 18] An illustration representing examples in (a) and (b) in which the illuminating device according to the invention is used for indoors.
Figure 18:
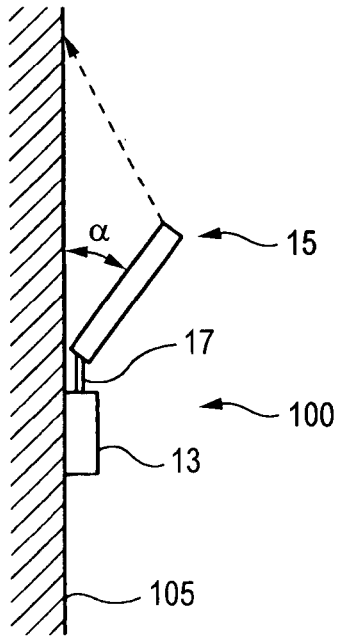

FIG. 18 is an illustration representing examples in (a) and (b) in which the illuminating device according to the invention is used for indoors.

The light source support 13 is secured to an indoor wall 105, and emergent light is projected onto an upper portion of the wall 105, thereby enabling the illuminating device 100 to be used also as an indirect illuminating device. In this case, by inclining the arm 17 at a prescribed angle $\alpha$ with respect to the wall 105, the irradiated areas S1, S2 and S3 are illuminated in a condition in which a difference in luminosity occurs between an irradiated center and both irradiated sides, obtaining a high level of effect properties.

In this way, as a modified example of the illuminating device 100 used for outdoors and indoors, it is also acceptable that the reflecting surface of the reflecting mirror member is roughed and formed into a satin-finished surface. That is, at least one of the reflecting surfaces of the first reflector 79 and the second reflector 81 can be formed into a satin-finished surface. According to this configuration, although the maximum illuminance is slightly reduced as compared with the case shown in FIG. 9, alight diffusion effect is increased, and a range in which an illuminance becomes uniform is widened, making it possible to carry out a wide range of illumination by one illuminating unit 19.

Consequently, according to the heretofore described illuminating device, as an illuminated range is made freely changeable, as well as it being possible to converge light from the LED's 69 with high efficiency without increasing an output of the LED's 69, and cause a high-illuminance illumination within the irradiated range, it is possible to separate the irradiated areas S1, S2 and S3 from the non-irradiated areas 101 with clear boundaries between them, and selectively illuminate a necessary desired area by excluding an area not desired to be illuminated. As a result, it becomes possible to use an illumination energy with high efficiency, making it possible not only to solve a light pollution problem, but to contribute to a reduction in CO2 generation.

Although the invention has been described in detail with reference to a specified embodiment, it is manifest to those skilled in the art that various alternations and modifications can be made without departing from the spirit and scope of the invention.

The present application is based on Japanese Patent Application No. 2005-249985 filed on Aug. 30, 2005, and contents thereof are incorporated herein as a reference.

The invention claimed is:

1. An illuminating device in which an illumination direction is freely changeable, comprising:

a light source portion that comprises:

a light emitter including a base and a plurality of light emitting diodes installed on the base;

a first reflector including parabolic surfaces that are provided for each of the light emitting diodes on a light emergence side, each of the parabolic surfaces having a focal position being set at a light emitting face of the respective light emitting diodes; and a second reflector including a pair of flat plate-like reflecting surfaces being arranged with the light emitting diodes sandwiched therebetween, the second reflector being disposed farther to the light emergence side than the first reflector and parallel to an array direction of the light emitting diodes, and the second reflector reflecting light from the light emitting diodes toward the light emergence side;

an arm that is attached to the light source portion at one end of the arm; and a light source support that rotatably supports another end of the arm.

2. The illuminating device according to claim 1, wherein a plurality of lamp units each including the light source portion and the arm are supported on the light source support.

3. The illuminating device according to claim 1, wherein the light source portion is supported to be pivotable with respect to an axis of the arm, and wherein a light irradiation direction of the light source portion is configured to be variable by pivoting the light source portion.

4. The illuminating device according to claim 1, further comprising a casing that surrounds a periphery of the light source portion, the casing having a transparent window being provided on the light emergence side of the light source portion.

5. The illuminating device according to claim 1, further comprising a joint that detachably connects the light source portion and the arm.

6. An illuminating device according to claim 1, wherein at least one of the reflecting surfaces of the first reflector and the second reflector is formed into a satin-finished surface.

* * * * *